United States Patent [19]

Iwahara et al.

[11] 4,143,244

[45] Mar. 6, 1979

[54] BINAURAL SOUND REPRODUCING SYSTEM

[75] Inventors: Makoto Iwahara; Fumio Maruyama; Goro Fujiki; Toshinori Mori; Norio Hiyama; Mitsuru Kikuchi, all of Yokohama, Japan

[73] Assignee: Victor Company of Japan, Limited, Japan

[21] Appl. No.: 752,964

[22] Filed: Dec. 21, 1976

[30] Foreign Application Priority Data

Dec. 26, 1975 [JP] Japan ..... 50/157194

[51] Int. Cl.[2] ..... H04R 5/04

[52] U.S. Cl. ..... 179/1 G

[58] Field of Search ..... 179/1 G, 1 J, 1 GQ, 179/100.4 ST

[56] References Cited

U.S. PATENT DOCUMENTS

| | | | |
|---|---|---|---|
| 3,920,904 | 11/1975 | Blauert et al. | 179/1 G |
| 3,970,787 | 7/1976 | Searle | 179/1 G |
| 3,985,960 | 10/1976 | Wallace | 179/1 G |

*Primary Examiner*—Douglas W. Olms

*Attorney, Agent, or Firm*—Robert E. Burns; Emmanuel J. Lobato; Bruce L. Adams

[57] ABSTRACT

A binaural sound reproducing system includes a transducer for translating the recorded binaural information into an electrical signal on each of separate channels and a convolution integrator on each separate channel connected to receive the output from the transducer to compensate for acoustical differences resulting from the facial difference between the dummy head used for recording the binaural signal and a particular listener.

1 Claim, 4 Drawing Figures

BINAURAL SOUND REPRODUCING SYSTEM

FIELD OF THE INVENTION

The present invention relates generally to binaural sound recording and reproducing systems, and in particular to a binaural sound reproducing system which incorporates means for compensating for acoustical differences resulting from the difference in facial features between a particular listener and a dummy head which simulates the general facial characteristics of the average human head.

BACKGROUND OF THE INVENTION

The conventional binaural sound recording and playback system uses a dummy head which simulates the human head in shape and dimensions and a pair of microphones each mounted on each eardrum of the dummy head. The signals picked up by the microphones are supplied to the headphones worn by the listener. He hears the original sound as if sitting at the location of the dummy head. However, the true binaural effect is only produced when all of the original sound sources are localized at right places in the reproduced sound field (in acoustic terminology the sonic images are correctly localized). In practical applications, the binaural signals are recorded into tapes or phonograph records and this necessitates the use of a dummy head which simulates only the general facial features of the average human head. Therefore, differences in facial features occur inevitably between the dummy head and a particular listener and such differences have resulted in dislocation of the sonic images of the original sound sources or distortion of the sonic image. Specifically, the frontal sonic image tends to be localized overhead or within the head of the listener.

SUMMARY OF THE INVENTION

According to our experiments, it was found that the sonic images of the original sound sources located on a horizontal plane (disregarding the depth of sound) can be faithfully localized regardless of the facial differences between the dummy head and the listener, while frontal sonic images of the original sound sources located on a vertical plane which bisects the dummy head, cannot be faithfully localized unless such facial differences are compensated.

Therefore, the primary object of the present invention is to provide an improved binaural sound reproducing system which eliminates the dislocation of frontal sonic images from where they should be localized.

Another object of the invention is to provide an improved binaural sound reproducing system which compensates for the acoustical difference resulting from the facial difference between the standard dummy head and a particular listener.

BRIEF DESCRIPTION OF THE DRAWINGS

The invention will be further described by way of example with reference to the accompanying drawings, in which.

DESCRIPTION OF THE PREFERRED EMBODIMENT

Figure 1:
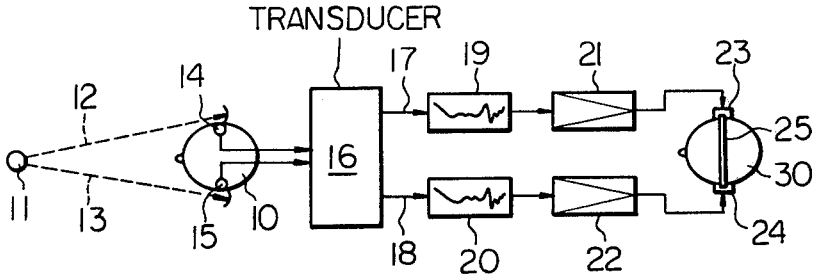
FIG. 1 is a schematic block diagram of an overall binaural recording and reproducing system embodying the present invention.

A binaural recording and reproducing system embodying the present invention is shown schematically in FIG. 1. A dummy head 10 is placed in front of a sound source 11 shown as emitting sound waves typically indicated by broken lines 12 and 13 which are received respectively by right and left microphones 14 and 15 mounted within the right and left eardrums of the dummy head. The signals from the microphones 14 and 15 are fed into a transducer 16 which may be a conventional stereophonic sound recording and reproducing apparatus or a broadcasting system which broadcasts the signals on the right and left channels. In the case of stereophonic recording, the signals on the right and left channels are separately recorded on individual tracks or grooves as in the well-known manner. The transducer 16 includes a suitable conventionally available means for reproducing the transmitted or recorded signals on its output channels 17 and 18. The signals on channels 18 and 19 are coupled to compensating circuits 19 and 20, respectively, which compensate for the differences in acoustical characteristic between the dummy head 10 and a particular listener 30. The compensated signals are amplified at 21 and 22 and fed into right and left earpieces 23 and 24 of the headset 25 worn by the listener 30.

Figure 2:
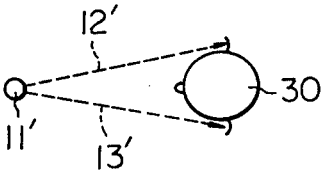
FIG. 2 is a schematic illustration showing a listener at the location of the dummy head of the system of FIG. 1 to measure the particular acoustic transmission characteristics of the listener.

Referring to FIG. 2 in which the listener 30 is shown seated at the location of the dummy head 10 to receive the sound waves on paths 12' and 13' on his respective ears. If the listener 30 in FIG. 1 receives the same sonic images as he would receive at the location of the dummy head in FIG. 2, then the acoustic difference due to the facial difference have been compensated for by the compensating circuits 19 and 20. Such compensation is achieved when the following equations are satisfied:

$$DH_R \cdot EQ_R \cdot A \cdot HP_R = M_R \cdot D \quad (1)$$

$$DH_L \cdot EQ_L \cdot A \cdot HP_L = M_L \cdot D \quad (2)$$

where, $DH_R$ = characteristic of the acoustic path 12 to the right microphone 14;

$DH_L$ = transmission characteristic of the acoustic path 13 to the left microphone 15;

$EQ_R$ = characteristic of the compensating circuit 10;

$EQ_L$ = characteristic of the compensating circuit 20;

A = amplification factor of each of the amplifiers 21 and 22;

$HP_R$ = transmission characteristic between right earpiece 23 and right ear of the listener 30;

$HP_L$ = transmission characteristic between left earpiece 24 and left ear of the listener 30;

$M_R$ = transmission characteristic of path 12' to the right ear of the listener 30 in FIG. 2;

$M_L$ = transmission characteristic of path 13' to the left ear of the listener 30 in FIG. 2; and D = delay time From Equations (1) and (2), the characteristics of the compensating circuits 19 and 20 can be obtained as follows:

$$EQ_R = \frac{M_R \cdot D}{DH_R \cdot A \cdot HP_R} \quad (3)$$

$$EQ_L = \frac{M_R \cdot D}{DH_L \cdot A\ HP_L} \quad (4)$$

The delay time D is necessary because $M_R/DH_R \cdot A \cdot HP_R$ or $M_L/DH_L \cdot A \cdot HP_L$ cannot be realized theoretically since the output signal would precede the input signal if the delay time D is not present.

Figure 3:
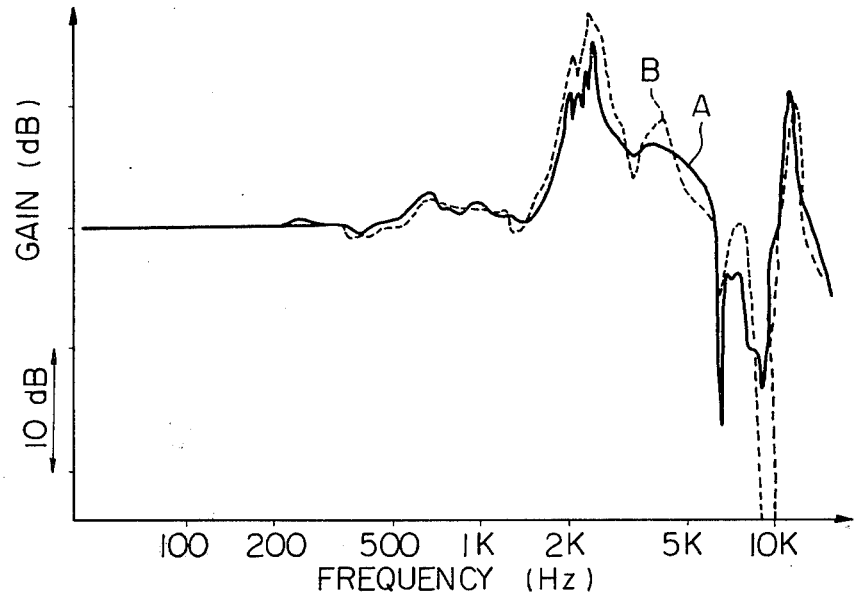
FIG. 3 is the result of the measurement of the acoustic transmission characteristic of the listener of FIG. 2 in which gain is plotted as a function of frequency of the sound wave.

In order to determine the transmission characteristic $M_R$, a small microphone is mounted within the right eardrum of the listener 30 and the listener 30 is seated at an equal distance from the sound source 11' to the distance between the sound source 11 and the dummy head 10. A measurement is conducted within a room having a substantially similar acoustic characteristic to that in which binaural sound recording is made. The sound source 11' is arranged to generate an acoustic wave of equal amplitude over the audible frequency spectrum. The sound pressure at the right ear of the listener represents the transmission characteristic $M_R$ which is obtained by plotting the intensity of the signal from the microphone as the frequency of the sound source is swept across the spectrum range to provide a curve A of FIG. 3. In like manner, the transmission characteristic $M_L$ is determined by mounting the microphone as used in the previous measurement within the left eardrum of the listener. Curve B of FIG. 3 indicates the characteristic $M_L$ of the listener 30.

Figure 4:
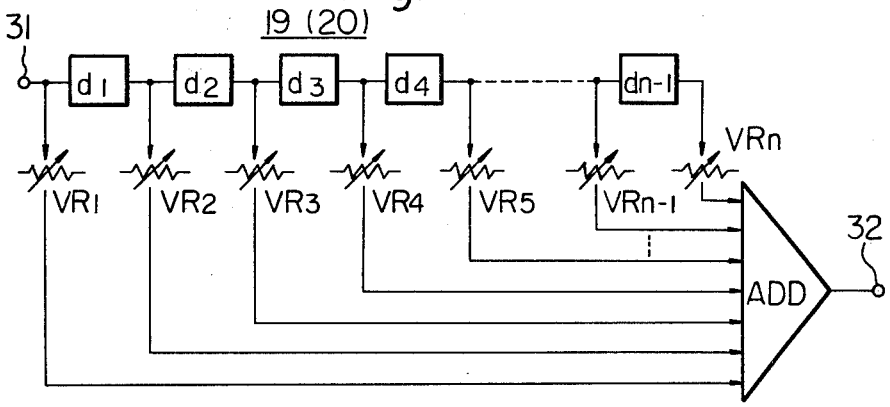
FIG. 4 is a circuit diagram of a convolution integrator used in the embodiment of FIG. 1.

The compensation circuit 19 may be realized by a convolution integral circuit as illustrated in FIG. 4. The compensating circuit comprises a plurality of delay circuits or elements $d_1$ through $d_{n-1}$ connected in series circuit relationship to the input terminal 31 connected to channel 17, a plurality of amplitude varying means or variable resistors $VR_1$ through $VR_n$, and an adder ADD. The variable resistor $VR_1$ is connected between the input terminal 31 and a first input of the adder, and resistors $VR_2$ to $VR_{n-1}$ are each connected across the junction between successive ones of the delay circuits and respective ones of the inputs to the adder. Variable resistor $VR_n$ is connected between the output of delay circuit $d_{n-1}$ and the "n"th input of the adder. The output of the adder is connected to an output terminal 32 which is connected to the amplifier 21.

Adjustment of the variable resistors of compensating circuit 19 is made in a manner as described as follows: With the arrangement of FIG. 1, the sound source 11 transmits an acoustic wave of equal amplitude across the audible frequency spectrum and the received signals at the microphones 14 and 15 are recorded in a suitable recording medium by the transducer 16. The recorded material thus contains the transmission characteristics $DH_R$ and $DH_L$ associated with the dummy head 10. The recorded material is then reproduced and applied through the right and left channels of the arrangement to the right and left earpieces 23 and 24. A small microphone as used in the measurement of the curves A and B is mounted in the right ear of the listener 30. With the microphone so mounted, the listener 30 wears the headset 25. The signal received by the microphone in the listener's right ear is plotted as the recorded signal sweeps across the frequency spectrum. As the frequency is swept, the variable resistors of the compensating circuit 19 are adjusted in such manner that the plotted curve follows closely the curve A of FIG. 3. Adjustment of variable resistors of the compensating circuit 20 is identical to that described above in connection with the right channel of the system.

A preferred method for adjusting the convolution integrators 19 and 20 is performed in a manner as follows: Firstly, the sound source 11' is arranged to produce an impulsive sound wave to determine the impulse response characteristic of the listener 30 who wears a microphone in each of his ears as in the previous manner. The signal from each microphone is fed into an oscilloscope to plot the signal intensity as a function of time. The trace of the oscilloscope is then photographed. Secondly, in the arrangement of FIG. 1 with microphones mounted on the listener's ears as in the previous manner and an oscilloscope connected to the microphones, the same impulsive sound wave is generated from the sound source 10. The signals from the microphones 14 and 15 thus contain the impulse response characteristics of the dummy head 10 and are applied through the convolution integrators and amplifiers on respective channels to the microphones mounted in the listener's ears. By comparing the trace on the oscilloscope with the impulse response characteristic of the photograph, each variable resistor of the convolution integrator is adjusted. Since the impulse response characteristic is plotted in terms of delay time and the variable resistors $VR_1$ to $VR_n$ are associated with respective delay elements, adjustment of the variable resistors can be easily made by comparison of the signal intensity of a given point in time on the time axis of the photographed characteristic with the signal intensity traced on the corresponding point in time on the oscilloscope.

What is claimed is:

1. A method of compensating for differences between the acoustic characteristic of a dummy head simulating a human head and the acoustic characteristic of a listener, comprising the steps of:

generating acoustic energy varying in frequency with time in an audible range to give a constant sound pressure level at a given point of a listening area throughout said frequency range;

plotting the sound pressure at ears of said listener located at said given point as a function of frequency to determine the acoustic characteristic of said listener;

locating said dummy head at said given point to receive said acoustic energy at the artificial ears of the dummy head and connecting the received energy to a stereophonic sound reproduction system to produce a signal representative of said acoustic energy at the ears of said listener;

successively delaying said signal in a respective channel of the sound reproduction system;

providing weighting factors to the nondelayed and successively delayed signals;

summing up the weighted signals; and adjusting each of said weighting factors such that the sound pressure level at the ears of said listener varies identically with said determined acoustic characteristic of said listener.

* * * * *